US008573939B2

(12) United States Patent
Borufka et al.

(10) Patent No.: US 8,573,939 B2
(45) Date of Patent: Nov. 5, 2013

(54) SHROUD FOR ROTATING BLADES OF A TURBO MACHINE, AND TURBO MACHINE

(75) Inventors: Hans-Peter Borufka, Starnberg (DE); Hernan Victor Arrieta, Rzeszow (PL); Klemens Hain, Wiedenzhausen (DE)

(73) Assignee: MTU Aero Engines GmbH, Munich (DE)

( * ) Notice: Subject to any disclaimer, the term of this patent is extended or adjusted under 35 U.S.C. 154(b) by 433 days.

(21) Appl. No.: 12/991,627

(22) PCT Filed: Apr. 30, 2009

(86) PCT No.: PCT/DE2009/000630

§ 371 (c)(1),
(2), (4) Date: Jan. 14, 2011

(87) PCT Pub. No.: WO2009/138057

PCT Pub. Date: Nov. 19, 2009

(65) Prior Publication Data

US 2011/0103956 A1 May 5, 2011

(30) Foreign Application Priority Data

May 13, 2008 (DE) ..... 10 2008 023 326

(51) Int. Cl.
*F01D 5/10* (2006.01)
*F01D 5/26* (2006.01)

(52) U.S. Cl.
USPC ..... 416/190

(58) Field of Classification Search
USPC ..... 416/190, 191, 194, 195, 196 R
See application file for complete search history.

(56) References Cited

U.S. PATENT DOCUMENTS

| | | | | | |
|---|---|---|---|---|---|
| 4,710,102 | A * | 12/1987 | Ortolano | 416/190 |
| 4,948,338 | A * | 8/1990 | Wickerson | 416/92 |
| 5,154,581 | A * | 10/1992 | Borufka et al. | 416/190 |
| 6,164,916 | A * | 12/2000 | Frost et al. | 416/189 |
| 7,001,152 | B2 * | 2/2006 | Paquet et al. | 416/190 |
| 2004/0151582 | A1 | 8/2004 | Faulkner | |
| 2007/0012046 | A1 * | 1/2007 | Larsson et al. | 60/791 |
| 2008/0038116 | A1 * | 2/2008 | Zemitis et al. | 416/191 |

FOREIGN PATENT DOCUMENTS

| | | |
|---|---|---|
| DE | 4015206 C1 | 10/1991 |
| JP | 07332003 | 12/1995 |

* cited by examiner

*Primary Examiner* — Nathaniel Wiehe
*Assistant Examiner* — Michael Sehn
(74) *Attorney, Agent, or Firm* — Barlow, Josephs & Holmes, Ltd.

(57) ABSTRACT

A shroud for the rotating blades of a turbo machine, particularly a gas turbine, in which shroud is arranged along the circumference of a row of several rotating blades disposed on a rotor and has at least one separation gap along its circumference. The separation gap is formed in zigzag shape and has at least three damping gaps that are distanced from one another and extend at an angle relative to an axis of rotation of the rotor, and adjacent to these, has connection gaps each connecting damping gaps or extending the latter in the direction of shroud edges, wherein, when the rotor rotates, the gap width of damping gaps is reduced until the gap walls forming the damping gaps come to rest against each other.

15 Claims, 3 Drawing Sheets

SHROUD FOR ROTATING BLADES OF A TURBO MACHINE, AND TURBO MACHINE

The present invention relates to a shroud for rotating blades of a turbo machine, particularly a gas turbine, wherein the shroud is disposed along the circumference of a row of several rotating blades disposed on a rotor and has at least one separation gap along the circumference. In addition, the invention relates to a turbo machine, particularly a gas turbine, comprising at least one rotor, which has at least one row of several rotating blades.

In turbo machines, particularly in gas turbines of turbo engines, the sealing gap between rotating blades and the stationary engine housing represents an influence factor that is of considerable importance for the efficiency of the engine. In order to minimize this sealing gap, it is known in the case of gas turbines to provide the latter with a shroud, which is disposed on the tips of the blades. A shroud is known from DE 40 15 206 C1 for an integral wheel having at least one Z-shaped separation gap disposed along the circumference and having damping gaps of minimum gap width disposed at an angle to the axial direction as well as open gap segments adjacent thereto. In this case, the damping gaps lying parallel to one another form the two parallel legs of the Z-shaped separation gap and are aligned at an angle of 70° to 90° relative to the axial direction of the integral wheel. Under certain operating conditions, the damping gaps lie close together, while the Z crosspiece is formed as an open gap running in the direction of the edges of the shroud. In this way, an unhindered circumferential shift of the shroud is possible, in order to assure a tension-free equilibration of thermal expansion. In addition, the two damping gaps offer a friction surface, which makes possible a corresponding damping of friction from vibrations of the integral wheel during operation.

However, resulting particularly from the ever higher speeds of turbo machines, especially of gas turbines of an aircraft engine, there also exists the necessity of further reducing or further counteracting the vibrations occurring in the main operating region, vibrations which arise, in particular, due to the fundamental characteristic frequencies of the bladed disk, i.e., the total blade/rotor system. In addition, there is also a need for improving the coupling rigidity of adjacent blades relative to one another.

It is thus the object of the present invention to provide a shroud for rotating blades of a turbo machine of the generic type and a turbo machine of the generic type, which assure a predominantly resonance-free operation of bladed turbo machines and an improvement of the coupling rigidity of adjacent blades relative to one another.

These objects are accomplished by a shroud according to the features of claim 1 as well as a turbo machine according to the features of claim 9.

Advantageous embodiments of the invention are described in the respective subclaims.

A shroud according to the invention for the rotating blades of a turbo machine, particularly a gas turbine, is arranged along the circumference of a row of several rotating blades disposed on a rotor and has at least one separation gap along its circumference. In this case, the separation gap has a zigzag shape and has at least three damping gaps that are distanced from one another and extend at an angle to an axis of rotation of the rotor, and adjacent thereto, connection gaps connecting each of the damping gaps or extending them in the direction of the edges of the shroud, wherein, when the rotor is rotated, the gap width of the damping gaps is reduced until the gap walls forming the damping gaps rest against one another. Due to the formation of at least three damping gaps that are distanced from one another, the contact surface that is available overall for damping friction under the operating conditions of the turbo machine is clearly increased. In this way, a predominantly resonance-free operation of bladed turbo machines and also an improvement of the coupling rigidity of adjacent blades relative to one another are assured. This results in a continuous distribution of the power flow along the damping gaps or the contact sites of the respective gap walls. The resonance-free main operating range is produced by control of the fundamental characteristic frequencies of the bladed disk (total blade/rotor system) through the possibility of an individual configuration of the support and bracing kinematics of the separation gaps that are formed.

In advantageous embodiments of the shroud according to the invention, the damping gaps are aligned at an angle of 60° to 90° relative to the axis of rotation of the rotor. In this way, it is advantageously assured that when the turbo machine is sped up, the circumferential extension of the shroud resulting from centrifugal forces can occur without being hindered. It is also possible that at least two of the damping gaps are aligned parallel to one another, so that an approximately simultaneous contact of the gap walls forming the damping gaps is produced.

In another advantageous embodiment of the shroud according to the invention, the shroud is divided into individual shroud segments, whereby each shroud segment is assigned to a rotating blade and is disposed thereon, and the individual shroud segments together with the adjacent shroud segments in each case form the separation gaps in the circumferential direction. However, it is also possible that each shroud segment is assigned to a group of at least two rotating blades and is disposed thereon, and the individual shroud segments together with the adjacent shroud segments in each case form the separation gaps in the circumferential direction. There is also the possibility that the rotating blades are formed integrally with the shroud segments. Depending on the requirements for the turbo machine to be designed in each case, the shroud according to the invention can have different advantageous configurations and arrangements. The dividing of the shroud into shroud segments increases the variability range of its applications. In particular, it is also possible to form the rotating blades integrally with the shroud segments, i.e., to form them in one piece. This leads to a simplified production process and thus to reduced production costs.

In another advantageous embodiment of the shroud according to the invention, at least one sealing lip is disposed along the outer circumference of the shroud. In particular, two sealing lips that are distanced from one another and disposed parallel to one another can be formed. In this case, the sealing lips can be interrupted in the region of the separation gaps. Due to the arrangement of the sealing lips, there results another advantageous reduction of the sealing gap between the rotating blades or the shroud and the stationary engine housing, whereby the efficiency of the turbo machine, particularly the gas turbine, is clearly improved.

In another advantageous embodiment, the shroud according to the invention is used in a low-pressure turbine, particularly a low-pressure turbine of an aircraft engine.

A turbo machine according to the invention, particularly a gas turbine, comprises at least one rotor, which has at least one row of several rotating blades, in which a shroud according to the embodiment examples described in the preceding is disposed along the circumference of the row of rotating blades. Based on the configuration of the shroud, the turbo machine according to the invention assures a predominantly resonance-free operation and an improvement of the coupling rigidity of adjacent blades relative to one another. In this way, a clear increase in the efficiency of the turbo machine results. In particular, the turbo machine in this case can be a low-pressure turbine, especially a low-pressure turbine of an aircraft engine. The rotating blades can also be components of an integral rotor construction, i.e. BLISK or BLING.

Other advantages, features and details of the invention result from the following description of an example of embodiment shown in the drawing. Here:

Figure 1:
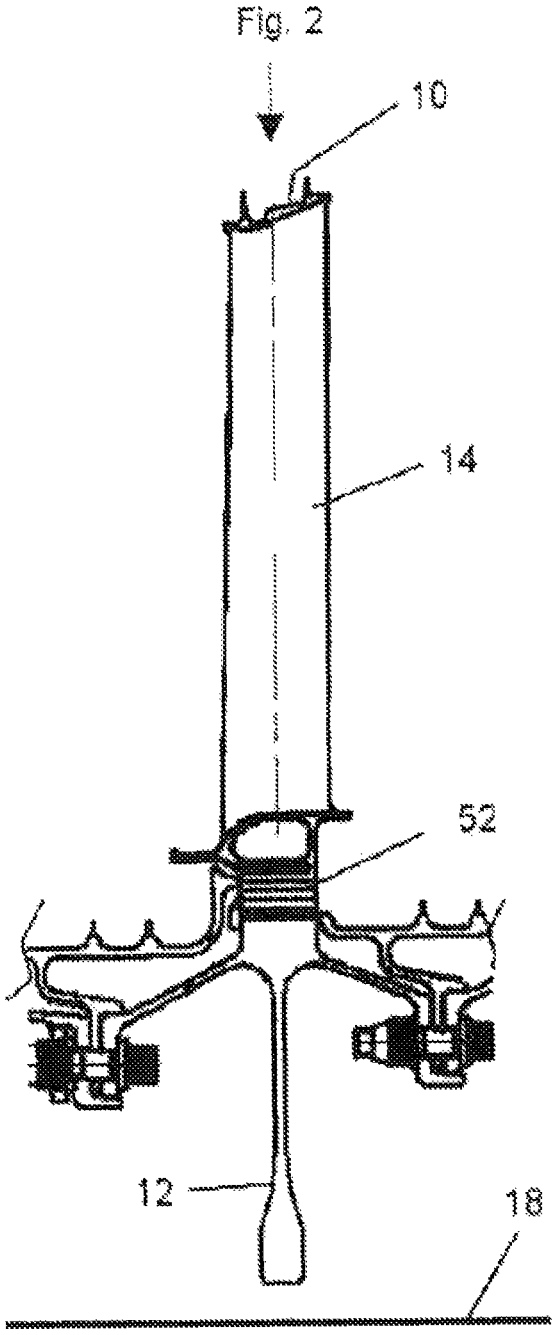
FIG. 1 shows a schematic representation of a part of a turbo machine having a shroud according to the invention.

FIG. 1 shows a schematic representation of a part of a turbo machine comprising a rotating blade 14 with a blade foot 52, the blade foot 52 being disposed on a rotor 12. Rotor 12 can thus be rotated around an axis 18. A shroud 10 is disposed on rotating blade 14 at the end lying opposite blade foot 52. Shroud 10 is thus disposed along the circumference of a row comprising several rotating blades and disposed on rotor 12.

Figure 2:
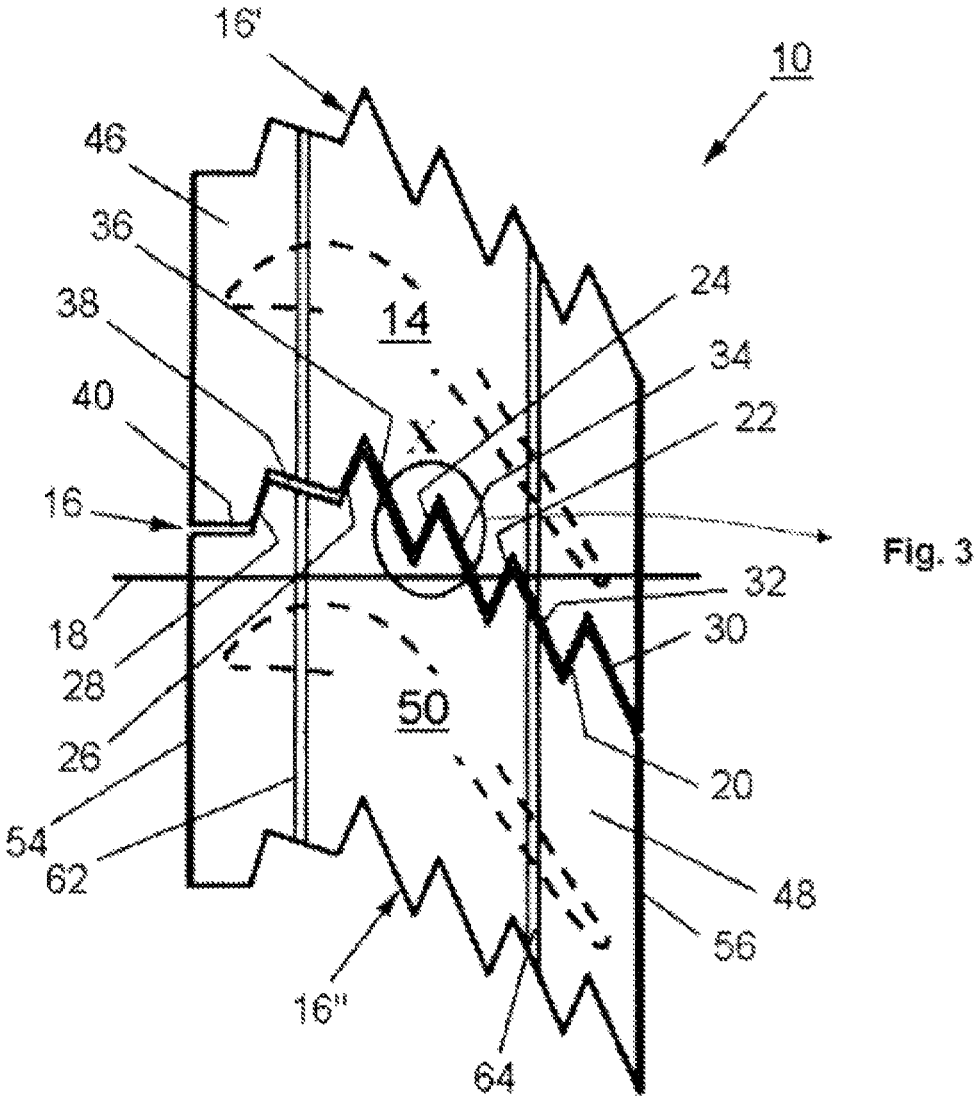
FIG. 2 shows a schematic representation of a top view onto the shroud according to the invention.
Figure 3:
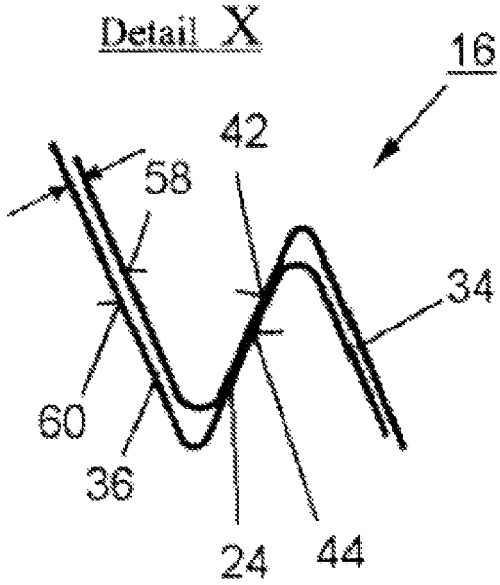
FIG. 3 is an inset from FIG. 2, showing a schematic representation of a close-up, top view of the separation gap in the shroud according to the invention.

FIG. 2 shows a schematic representation of a top view onto shroud 10. It is known that shroud 10 has several separation gaps 16, 16', 16" along its circumference, whereby separation gaps 16, 16', 16" are formed in zigzag shape. The separation gaps 16, 16', 16" are best seen in inset view FIG. 3. In the example of embodiment shown, the separation gaps 16, 16', 16" each comprise five damping gaps 20, 22, 24, 26, 28 that are distanced from one another and extend at an angle to axis of rotation 18 of rotor 12, and connection gaps 30, 32, 34, 36, 38, 40 adjacent to these, each of the latter connecting damping gaps 20, 22, 24, 26, 28 or extending them in the direction of shroud edges 54, 56. From detail X shown in the figure, it is also clear that when the rotor 12 rotates, the gap width of damping gaps 20, 22, 24, 26, 28 is reduced until the gap walls 42, 44 forming damping gaps 20, 22, 24, 26, 28 come to rest against each other. In contrast, gap walls 58, 60 of connection gaps 30, 32, 34, 36, 38, 40 also form a gap, in addition, during the rotation of the rotor. Referring to FIG. 3, only a partial region of separation gap 16 is shown in detail X. In addition, it is clear that in the example of embodiment that is shown, shroud 10 is divided into individual shroud segments 46, 48, wherein each shroud segment 46, 48 is assigned to a rotating blade 14, 50 and is disposed thereon. The individual shroud segments 46, 48 form separation gaps 16, 16', 16" with the adjacent shroud segments in each case in the circumferential direction. In this way, the separation gaps 16, 16', 16" are formed parallel to one another, i.e., the individual damping and connection gaps run parallel to one another in each case.

In addition, it is clear that damping gaps 20, 22, 24, 26, 28 are aligned at an angle of 60° to 90° each time relative to the axis of rotation 18 of rotor 12. In the example of embodiment which is shown, a total of four damping gaps 20, 22, 24, 26 are aligned parallel to one another. Another damping gap 28 runs at an acute angle to the damping gaps 20, 22, 24, 26, which were described previously. It is also recognized that the connection gaps 30, 32, 34, 36, 38, 40 may occupy different angles in a range between 0° and 90° relative to the axis of rotation 18 of the rotor.

In the example of embodiment which is shown, two sealing lips 62, 64, which run parallel to one another, are formed along the outer circumference of shroud 10. The sealing lips are interrupted in the region of separation gaps 16, 16', 16". Due to sealing lips 62, 64, there results another advantageous reduction of the sealing gap between shroud 10 and a stationary housing of the turbo machine, particularly a stationary engine housing (not shown), which is adjacent thereto.

The invention claimed is:

1. A shroud for the rotating blades of a turbo machine wherein a shroud (10) is arranged along the circumference of a row of several rotating blades (14, 50) disposed on a rotor (12) and has at least one separation gap (16, 16', 16") along its circumference, the at least one separation gap (16, 16', 16") is formed in zigzag shape and has at least two damping gaps (20, 22, 24, 26, 28) which are distanced from one another and extend at an angle to an axis of rotation (18) of rotor (12), and adjacent thereto, one of the damping gaps (28) running at an acute angle to remaining damping gaps (20, 22, 24, 26) which are aligned at an angle of 60° to 90° relative to the axis of rotation (18) of rotor (12), has connection gaps (30, 32, 34, 36, 38, 40), each connecting damping gaps (20, 22, 24, 26, 28) or extending them in the direction of the edges of the shroud (54, 56), is hereby characterized in that, when rotor (12) rotates, the gap width of damping gaps (20, 22, 24, 26, 28) is reduced until the gap walls (42, 44) forming the damping gaps (20, 22, 24, 26, 28) come to rest against each other.

2. The shroud according to claim 1, further characterized in that at least two of the remaining damping gaps (20, 22, 24, 26) are aligned parallel to one another.

3. The shroud according to claim 1, further characterized in that shroud (10) is divided into individual shroud segments (46, 48), wherein each shroud segment (46, 48) is assigned to a rotating blade (14, 50) and is disposed thereon, and the individual shroud segments (46, 48) form separation gaps (16, 16', 16") with the adjacent shroud segments in each case in the circumferential direction.

4. The shroud according to claim 3, further characterized in that rotating blades (14, 50) are formed integrally with shroud segments (46, 48).

5. The shroud according to claim 1, further characterized in that shroud (10) is divided into individual shroud segments, wherein each shroud segment is assigned to a group of at least two rotating blades and is disposed thereon, and the individual shroud segments form the separation gaps with the adjacent shroud segments in each case in the circumferential direction.

6. The shroud according to claim 1, further characterized in that at least one sealing lip (62, 64) is disposed along the outer circumference of shroud (10).

7. The shroud according to claim 1, further characterized in that the turbo machine is a low-pressure turbine.

8. A turbo machine, comprising at least one rotor (12) having at least one row of several rotating blades (14, 50), which is characterized in that a shroud (12) according to claim 1 is arranged along the circumference of the row of rotating blades, the shroud further characterized in that it has at least one separation gap (16, 16', 16") along its circumference, the at least one separation gap (16, 16', 16") is formed in zigzag shape and has at least two damping gaps (20, 22, 24, 26, 28) which are distanced from one another and extend at an angle to an axis of rotation (18) of rotor (12), and adjacent thereto, one of the damping gaps (28) running at an acute angle to the remaining damping gaps (20, 22, 24, 26) which are aligned at an angle of 60° to 90° relative to the axis of rotation (18) of rotor (12).

9. The turbo machine according to claim 8, further characterized in that the turbo machine is a low-pressure turbine.

10. The turbo machine according to claim 8, further characterized in that rotating blades (14, 50) are components of an integral rotor construction.

11. The turbo machine according to claim 8, wherein there are at least three damping gaps.

12. The turbo machine according to claim 8, wherein the turbo machine is a gas turbine.

13. The turbo machine according to claim 12, wherein the gas turbine is a low pressure turbine of an aircraft engine.

14. A shroud for the rotating blades of a turbo machine wherein a shroud (10) is arranged along the circumference of a row of several rotating blades (14, 50) disposed on a rotor (12) and has at least one separation gap (16, 16', 16") along its circumference, the at least one separation gap (16, 16', 16") is formed in zigzag shape and has at least five damping gaps (20, 22, 24, 26, 28) which are distanced from one another and extend at an angle to an axis of rotation (18) of rotor (12), and adjacent thereto, wherein a total of four damping gaps (20, 22, 24, 26) are aligned parallel to one another and another damping gap (28) runs at an acute angle to the four damping gaps (20, 22, 24, 26), has connection gaps (30, 32, 34, 36, 38, 40), each connecting damping gaps (20, 22, 24, 26, 28) or extending them in the direction of the edges of the shroud (54, 56), is hereby characterized in that, when rotor (12) rotates, the gap width of damping gaps (20, 22, 24, 26, 28) is reduced until the gap walls (42, 44) forming the damping gaps (20, 22, 24, 26, 28) come to rest against each other.

15. The shroud according to claim 14, further characterized in that the damping gaps (20, 22, 24, 26, 28) are aligned at an angle of 60° to 90° relative to the axis of rotation (18) of rotor (12).

* * * * *